US005223661A

United States Patent [19]

Sabri

[11] Patent Number: 5,223,661

[45] Date of Patent: Jun. 29, 1993

[54] RAPID AREA CLEARANCE OF EXPLOSIVES

[75] Inventor: Zeinab A. Sabri, LaPlace, La.

[73] Assignee: Technology International Incorporated, LaPlace, La.

[21] Appl. No.: 877,198

[22] Filed: May 1, 1992

Related U.S. Application Data

[62] Division of Ser. No. 586,150, Sep. 21, 1990, Pat. No. 5,140,891.

[51] Int. Cl.[5] ..... F42B 33/00; F42D 5/04

[52] U.S. Cl. ..... 89/1.13; 89/1.1

[58] Field of Search ..... 89/1.11, 1.13, 1.1; 86/50; 102/402

[56] References Cited

U.S. PATENT DOCUMENTS

| | | | |
|---|---|---|---|
| 3,265,598 | 2/1966 | Rohrman | 89/1.13 |
| 3,721,201 | 11/1973 | Boller | 86/50 |
| 3,771,413 | 7/1973 | Sieg et al. | 89/113 |
| 3,800,715 | 2/1974 | Boller | 86/50 |
| 4,046,055 | 7/1977 | McDanolds et al. | 86/50 |
| 4,493,239 | 4/1985 | Pedersen | 89/1.13 |
| 4,840,105 | 3/1989 | Ladan et al. | 89/1.13 |
| 4,919,034 | 1/1990 | Firth | 89/1.13 |
| 4,957,027 | 9/1990 | Cherry | 86/50 |

*Primary Examiner*—David H. Brown

*Attorney, Agent, or Firm*—Sixbey, Friedman, Leedom & Ferguson

[57] ABSTRACT

A system and process for neutralizing unexploded ordnances and clearing explosive infested areas such that maneuvers can be both readily and confidently continued without significant delay is disclosed. The system clears such unexploded ordnances infested areas by initially spraying the explosive infested area with a cryogenic liquid to neutralize the unexploded ordnances and reduce an output voltage of a detonator of the unexploded ordnances thereby rendering the unexploded ordnances inert, gathering the now unexploded ordnances and submerging the inert unexploded ordnances in a tank containing the same or similar cryogenic liquid so that the unexploded ordnances are maintained in a neutralized and inert state to allow for disposal. Alternatively, the neutralization of unexploded ordnance and clearing of explosive infested areas may be carried out by spraying the explosive infested area with liquefied methane to neutralize the unexploded ordnance and reduce an output voltage of a detonator of the unexploded ordnances to render such ordnance inert, igniting the liquefied methane, deflagrating the unexploded ordnances at a temperature less than that required for detonation and subsequently removing the neutralized ordnances from the explosive infested area.

8 Claims, 3 Drawing Sheets

RAPID AREA CLEARANCE OF EXPLOSIVES

This application is a division of Ser. No. 07/568,150, filed Sep. 21, 1990, now U.S. Pat. No. 5,140,891.

TECHNICAL FIELD

The invention relates generally to a system for the rapid area clearance of unexploded ordnance from critical air base sortie generation facilities for air base rapid recovery after attack (BRAAT) or explosive infested ranges. More particularly, the present invention relates to a system for neutralizing unexploded ordnance so that such unexploded ordnance may be safely removed from the infested area.

BACKGROUND OF THE INVENTION

Historically, explosive-filled ordnance such as mines and hidden explosive devices have proven to be a significant obstacle to be overcome in both low and high intensity conflicts. Mines and hidden explosive-filled ordnance destroyed over 25 percent of the vehicles lost in World War II, a percentage that almost tripled in the Viet Nam War. Because of the continued improvement in flexibility, sophistication, kill power, ease of use and effectiveness of such mines, the potential for the continued use of such mines and hidden explosives for area denial and barrier munitions will continue to play a vital role in successful defensive tactics.

Current explosive-filled ordnance neutralization techniques include plows, rollers or flails attached to the front of an armored vehicle, as well as projected explosive charges. One such technique is illustrated in U.S. Pat. No. 3,771,413 issued to Sieg et al. The mine neutralization device of this type employs wheels which are mounted on the vehicle, such as a tank, and are utilized to neutralize; i.e., detonate pressure actuated land mines buried in the ground which are in the vehicle's path of travel. Such neutralization techniques are rarely used until the presence of a mine field is established; and once established, these techniques are slow and vulnerable to covering fire. A mine field protected by covering fire can be extremely difficult to breach. Further, some of the mines in the mine field may be missed because of the use of an advanced fuze system or the use of infrequent individual mines.

The range clearance system set forth in U.S. Pat. No. 4,449,239 issued to Pedersen illustrates a method of clearing a target range or other areas such as a war zone of buried unexploded ordnance by enhancing oxidation of ferrous ordnance in situ. This method advances the natural galvanic electrochemical corrosion whereby ferrous parts of the unexploded ordnance are simply rusted away at an accelerated rate and rendered harmless within five to ten years. However, while such a system may be effective in clearing a target range for future use, this system is both impractical and unusable where it is desired to quickly and effectively clear explosive infested areas such that troops or other personnel may readily occupy the previously infested area.

Various other techniques have been employed to neutralize explosive devices. Examples of such are set forth in U.S. Pat. No. 4,046,055 issued to McDaniels et al. and U.S. Pat. No. 3,800,715 issued to Boller. Each of these devices employ the use of liquid nitrogen to cool the device to a temperature at which the device becomes inoperative. One such device requires penetrating the individual casing of the unexploded ordnance with the subsequent injection of liquid nitrogen into the device. With the device of Boller, an unexploded ordnance is drawn into an open-ended tubular shell which is then filled with liquid nitrogen to freeze the bomb to deactivate the explosive material contained therein. However, each of these devices is used to merely deactivate a single bomb and cannot readily or safely be used to neutralize unexploded ordnance scattered over a large explosive infested area. Remote clearing of mine fields from a distance may also be carried out by the use of projected explosive charges which can quickly clear paths. This procedure; however, requires large amounts of explosives and causes large airblasts which are often undesirable. Moreover, this procedure is often only effective in detonating single-impulse pressure mines. Consequently such a procedure may not reliably clear the unexploded ordnance infested area.

Clearly, there is a need for both a system and method for readily neutralizing unexploded ordnance and clearing explosive infested areas such that maneuvers may be continued in a rapid and a confident manner. Further, such neutralization and clearing must be capable of being carried out safely with the unexploded ordnance being continuously maintained in an inert state.

SUMMARY OF THE INVENTION

It is an object of the present invention to overcome the shortcomings associated with the above referenced prior art.

It is yet a further object of the present invention to provide a system that copes with all possible variations in expected unexploded ordnance types with reference to range, type and characteristics of explosive contained therein as well as volume, weight, arming/fuzing devices, influence, etc. Further, the system must account for the anticipated future development of munitions, including area denial munitions, combined effects munitions, smart weapons, sophisticated munitions, canister bomb units, submunitions, scatterable munitions and mines.

Rarely is the attack on an air base continuous, thus area denial munitions are often included as part of the attack so as to prolong the attack's effect. Therefore, it is yet another object of the present invention to provide a system which renders such area denial munitions inert and safe to remove.

Another object of the present invention is to provide a method of neutralizing unexploded ordnance and clearing explosive infested areas such that maneuvers can be both readily and confidently continued without significant delay. This may be accomplished by initially spraying the explosive infested area with a cryogenic liquid to neutralize the unexploded ordnance and reduce an output voltage of a detonator of the unexploded ordnance thereby rendering the unexploded ordnance inert, gathering the now inert unexploded ordnances and submerging the inert unexploded ordnances in a tank containing the same, or similar cryogenic liquid so that the unexploded ordnances are maintained in a supercooled and inert state and disposing of the unexploded ordnances.

In addition to the above, the neutralization of unexploded ordnance and clearing of explosive infested areas may be carried out by spraying the explosive infested area with liquefied methane to neutralize the unexploded ordnance and reduce an output voltage of a detonator of the unexploded ordnance to render such ordnance inert, igniting the liquefied methane, deflagrating the unexploded ordnance at a temperature less than that required for detonation and subsequently removing the unexploded ordnance from the explosive infested area.

Yet another object of the present invention is to provide a system for carrying out the above-mentioned process without subjecting personnel to unnecessary risk of explosion. The system includes a device for dispersing the cryogenic liquid about the explosive-infested area to render the unexploded ordnances inert, an armored bulldozer or similar device for gathering the inert unexploded ordnances, and a removal device for removing the gathered unexploded ordnances from the explosive-infested area.

DETAILED DESCRIPTION OF THE PREFERRED EMBODIMENT

Figure 1:
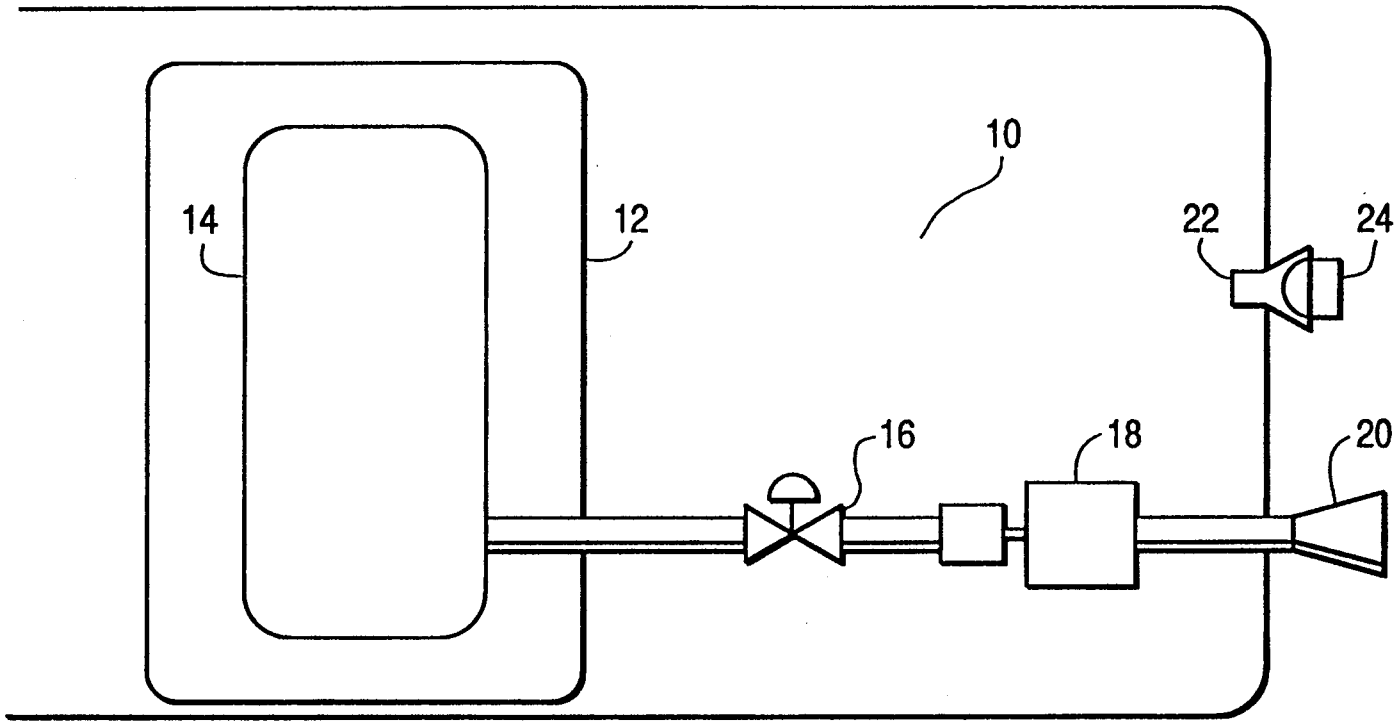
FIG. 1 is a schematic illustration of the neutralization system in accordance with the present invention.
Figure 2:
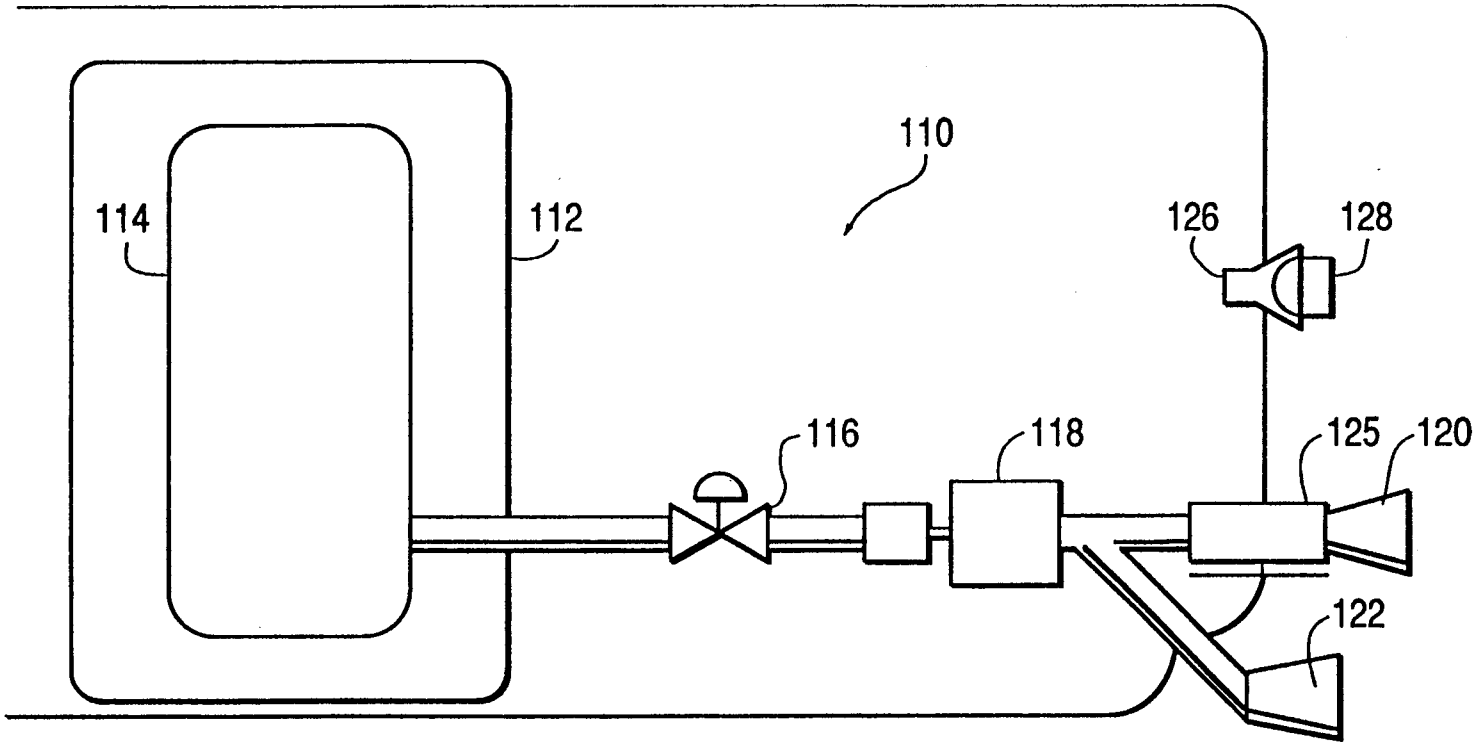
FIG. 2 is a schematic illustration of the neutralization system in accordance with an alternative embodiment of the present invention.
Figure 3:
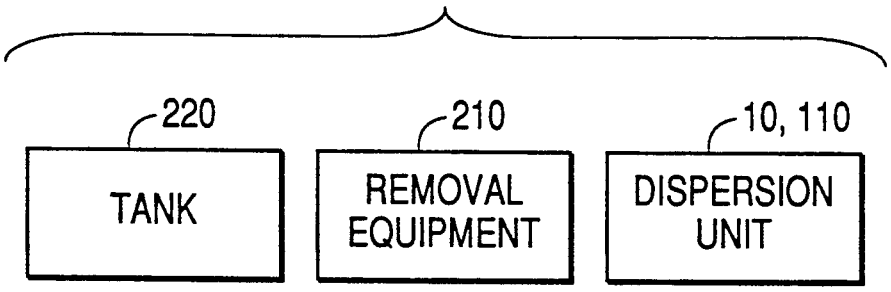
FIG. 3 is a schematic representative of the overall system in accordance with the present invention.

Referring now to FIGS. 1 and 2, the cryogenic system for disbursing cryogenic liquids about an explosive infested area is illustrated. FIG. 1 illustrates a dispersion unit 10 which may be readily mounted on the underside of a helicopter. The dispersion unit 10 includes an insulated refrigeration tank 12 which accommodates a cryogenic liquid storage tank 14. The flow of the cryogenic liquid is controlled by the valve 16 which when opened allows the cryogenic liquid from tank 14 to be pumped by the centrifugal pump 18 through the dispersion nozzle 20. While the particular characteristics of the dispersion nozzle 20 are not critical to the operation of the dispersion unit 10, the nozzle must be capable of dispersing cryogenic liquid over a large area.

Similarly, the dispersion unit 100 illustrated in FIG. 2 includes an insulated refrigeration tank 112 which receives a cryogenic liquid storage tank 114. The flow of cryogenic liquid through the dispersion unit 110 is controlled by valve 116 with a centrifugal pump 118 being of the capacity to supply a significant amount of cryogenic liquid through the upper dispersion nozzle 120 and lower dispersion nozzle 122. Because the dispersion unit 110 is to be mounted on a land vehicle, in order to disperse cryogenic liquid over a significant area, the upper dispersion nozzle 120 is mounted on a turret 125 so as to enable the upper dispersion nozzle 120 to pivot to and fro in order to disperse the cryogenic liquid over a path which is at least three times the width of the vehicle, or approximately 20–30 feet. The lower dispersion nozzle 122 is mounted close to the ground so as to soak an area approximately the width of the vehicle with cryogenic liquid. The dispersion nozzle 120 is mounted so as to disperse the cryogenic liquid at least 100 feet ahead of the vehicle. This allows for the immediate cooling of the unexploded ordnance prior to the time at which the vehicle reaches the unexploded ordnance.

In accordance with a first embodiment of the present invention, the cryogenic liquid storage tank 14, 114 may be filled with a variety of cryogenic liquid such as liquid nitrogen or liquid air. Liquid nitrogen would, in effect, be the preferred cryogenic liquids in that the presence of oxygen in liquid air may enhance the ever present threat of fire when dealing with flammables. Consequently, liquid nitrogen which is not readily susceptible to fire would be the preferred cryogenic liquid to be used in accordance with the present invention.

The cryogenic liquid may be either remotely produced and brought to the site for dispersion or produced by a mobile cryogenic liquid production plant of a capacity sufficient enough to produce an amount of cryogenic liquid appropriate to disperse a sufficient layer of cryogenic liquid over an unexploded ordinance infested area such as an air base. Mobile cryogenic liquid production plants capable of producing the requisite amounts of such product are presently commercially available.

Once produced, the cryogenic liquid is dispersed over an area by use of either the dispersion unit 10 which is carried by a helicopter or the dispersion unit 110 which is mounted to a land vehicle such as a tank. When using the latter system, a magnetic silencer and signature reduction devices must be fitted to the delivery vehicles so as to reduce noise and vibrations admitted by the vehicle in order to minimize the chance of the detonation of influence fuzing unexploded ordnances. If a significant amount of influence fuzing unexploded ordnance are present, a low influence remotely controlled robotic vehicle would be used to allow the neutralization process to be safely implemented. However, if influence fuzing unexploded ordnances are not present, the use of a helicopter as a delivery vehicle would more efficiently and more expeditiously render the infested area neutralized.

Once a specified area has been adequately covered by layer of approximately ½ inch of cryogenic liquid, the unexploded ordnances will be neutralized by the supercooling interference with the detonator within the explosive process. The system neutralizes what are known as smart munitions to reduce the battery output voltage to the point that electronic fuzing will not function. The neutralizing of the batteries of the unexploded ordnances causes a malfunction in the detonator and renders the unexploded ordnance inert or at least unable to detonate while neutralized.

Once the unexploded ordnances are rendered inert, they may be removed from the infested area by the use of an armored bulldozer or other type of removal equipment 210. The removal equipment may also be remotely controlled in order to ensure the safety of the operating personnel. Once the now neutralized unexploded ordnances are gathered together in one area, the unexploded ordnances may again be soaked with the cryogenic liquid in order to ensure the neutralization of the unexploded ordnances. The unexploded ordnances must then be reliably transported away from the infested area. In order to do so, the unexploded ordnances are placed in a tank 220 containing the cryogenic liquid so that the unexploded ordnances may be safely transported. The unexploded ordnances may be picked up by a remote manipulator so as to again ensure the safety of the operating personnel. Because the unexploded ordnances are now held safe in a neutralized state, the final disposition of the unexploded ordnances may be either done immediately or delayed until such time that the proper equipment and personnel may be used.

The system described hereinabove may be used for the neutralization of unexploded ordnances of a variety of types. The above neutralization system is effective regardless of the range, type an characteristics of the explosive contained within the unexploded ordnance, volumes, weights, arming/fuzing devices, etc. as well as anticipated future development of explosive ordnances. Moreover, because the neutralized unexploded ordnances are removed by an armored vehicle having a plow-type structure on its front, additional debris such as fragments of explosives as well as other objects that are found on runways or other infested areas will be removed.

The preceding embodiment of the present invention first sprays an area of approximately 25 feet in width and 100 feet in length, the armored vehicle then plows the sprayed area in order to move the unexploded ordnances to a small concentrated area. To be sure that the unexploded ordnances remain neutralized, the piled unexploded ordnances may be sprayed with an additional amount of cryogenic liquid. The removal vehicle then picks up the piled and neutralized unexploded ordnances and loads the unexploded ordnances into a tank containing the same or similar cryogenic liquid. Once the tank has been filled with unexploded ordnances, it is securely closed and transported for disposal and replaced by another tank containing the cryogenic liquid. This process would continue until the entire infested area has been neutralized.

As an alternative to the preceding embodiment of the present invention, cryogenic liquid methane or natural gas may be used as the neutralizing cryogenic liquid. In addition to the foregoing, a system employing cryogenic liquid methane is effective in neutralizing anti-personal and anti-amphibious vehicle mines usually encountered in surf areas, as well as those encountered on land.

The cryogenic liquid methane cools the mines to a temperature that renders the mines safe to burn without explosion and without the associated air blast. The effects of the very low temperatures on the unexploded ordnances causes the malfunction of the igniter and renders the explosives inert or at least unable to detonate while neutralized by reducing the battery output voltage of the detonator to the point that electronic fusing will not function. The cryogenic liquid methane may be produced by cascade refrigeration using several refrigerants in series. The refrigeration process would include cooling the gas, first by propane, then by ethylene, and finally by self-refrigeration. The ethylene is condensed by propane and the propane is condensed by water. The final methane pressure reduction may be achieved by the well-known Joule-Thomson effect of cooling by throttling. As with the previous embodiment, the cryogenic liquid methane may be brought to the site in tanks or produced in situ aboard the vehicle depending upon the type and size of the mine field to be cleared.

When neutralizing surf mines, a helicopter is used as the delivery vehicle; however, when influence fuzing unexploded ordnances are present in a field, a low influence remotely controlled robotic vehicle should be used to carry out the neutralization process. In either case, the delivery vehicle will spray the infested area with cryogenic liquid methane or natural gas which is then followed by the remote deflagration of the unexploded ordnances. In doing so, the explosives will burn but will not explode.

When neutralizing an unexploded ordnance infested surf area, a helicopter or other robotic aircraft carrying the dispersion unit 10 set forth in FIG. 1 is used to disperse cryogenic liquid methane about the area to be cleared. In addition to the dispersion unit 10, an igniter 24 containing flammable material and an adhering material for ignition of the boiling methane dispersed about the area will also be carried by the helicopter along with a launcher 22 to launch the flammable igniter.

The neutralization of the unexploded ordnance infested area is carried out by initially spraying an area of approximately 15 feet by 150 feet with the cryogenic methane, backing off away from the area and launching the igniter into the area to burn the disabled mines. Once this is accomplished, a new area is sprayed and the process is repeated until the entire area is neutralized. Each section takes approximately 4–5 minutes to burn when a layer of approximately ½ inch of cryogenic liquid methane is dispersed.

The igniter 24 which initiates the deflagration of the enabled mines may consist of a canister containing a highly flammable liquid such as methane and an adhesive such as rubber to ensure the ignition of a localized area. The igniter 24 would thereby be similar to a Molotouf cocktail.

When clearing mine fields a low influence armored vehicle, including the dispersion unit 110, illustrated in FIG. 2 would be used in dispersing the cryogenic liquid methane. The low influence armored vehicle would also include a launcher 126 for launching an igniting canister 128. The armored vehicle would initially spray a specified area with a layer of cryogenic liquid methane. The armored vehicle would then back away from the sprayed area and launch the igniting canister 128 containing a highly flammable liquid and an adhesive such as rubber into the sprayed area, thereby igniting the boiling liquid methane. Upon the total deflagration of the explosives in the initial area, the armored vehicle would then proceed to an adjacent area to be neutralized. Upon the total deflagration of the explosives, the now neutralized unexploded ordnances may be readily removed from the neutralized area by gathering the now neutralized shells, thus allowing personnel to occupy the area.

Therefore, by carrying out the above described procedures, a workable solution for the complete, overall and rapid clearance of unexploded ordnances from an infested area is provided. Furthermore, the above described systems provides a highly reliable neutralization system which is easy to deploy and capable of clearing large areas at high sweeping rates, with minimal logistics and manpower support.

While the invention has been set forth with reference to particular embodiments, it will be appreciated by those skilled in the art that the invention may be practiced otherwise than has been described without departing from the spirit and scope of the invention. It is, therefore, to be understood that the spirit and scope of the invention is to be limited only by the appended claims.

Industrial Applicability

While the above-described invention is particularly suited for the neutralization and the clearing of areas infested by unexploded ordnances, after an attack, the present invention may also be employed to clear artillery ranges and other test facilities of unexploded ordnances or to freeze food crops, as well as sea food crops, in situ prior to their harvesting.

What is claimed is:

1. A system for neutralizing unexploded ordnance and clearing explosive-infested areas comprising:

dispersion means for dispersing a cryogenic liquid about the explosive-infested area to render the unexploded ordnance inert;

gathering means for gathering the inert unexploded ordnance; and removal means for removing the unexploded ordnance from the explosive-infested area.

2. The system as defined in claim 1, wherein said cryogenic liquid is liquid air.

3. The system as defined in claim 1, wherein said cryogenic liquid is liquid nitrogen.

4. The system as defined in claim 1, wherein said cryogenic liquid is liquid methane.

5. The system as defined in claim 4, further comprising an igniting means for igniting the liquefied methane and deflagrating the unexploded ordnance at a temperature less than that required for detonation.

6. The system as defined in claim 5, further comprising a launching means for launching the igniting means into the explosive-infested area having the liquefied methane dispersed thereon.

7. The system as defined in claim 5, wherein said igniting means is a canister containing a flammable liquid and an adhesive agent.

8. The system as defined in claim 7, wherein said adhesive agent is rubber.

* * * * *